United States Patent [19]

Kirk et al.

[11] Patent Number: 4,758,359

[45] Date of Patent: Jul. 19, 1988

[54] AQUEOUS METAL WORKING LUBRICANT CONTAINING A COMPLEX PHOSPHATE ESTER

[75] Inventors: Thomas E. Kirk, Henrico County; Barry L. Riddle, Chesterfield, both of Va.

[73] Assignee: Reynolds Metals Company, Richmond, Va.

[21] Appl. No.: 100,066

[22] Filed: Sep. 23, 1987

Related U.S. Application Data

[63] Continuation-in-part of Ser. No. 23,887, Mar. 16, 1987, abandoned, which is a continuation-in-part of Ser. No. 14,323, Feb. 13, 1987, abandoned.

[51] Int. Cl.[4] ..... C10M 173/02; C10M 137/04

[52] U.S. Cl. ..... 252/32.5; 252/49.3; 252/49.8

[58] Field of Search ..... 252/32.5, 49.3, 49.8

[56] References Cited

U.S. PATENT DOCUMENTS

| | | | |
|---|---|---|---|
| 3,310,489 | 3/1967 | Davis | 252/32.5 |
| 3,966,619 | 6/1976 | Smith et al. | 252/32.5 |
| 4,521,321 | 6/1985 | Anderson et al. | 252/49.3 |
| 4,626,367 | 12/1986 | Kuwamoto et al. | 252/49.5 |
| 4,636,321 | 1/1987 | Kipp et al. | 252/49.3 |
| 4,654,155 | 3/1987 | Kipp et al. | 252/32.5 |

FOREIGN PATENT DOCUMENTS

| | | | |
|---|---|---|---|
| 2205692 | 5/1971 | Fed. Rep. of Germany | 252/49.9 |
| 279842 | 11/1970 | U.S.S.R. | 252/32.5 |
| 699007 | 11/1979 | U.S.S.R. | 252/49.9 |

*Primary Examiner*—William R. Dixon, Jr.
*Assistant Examiner*—Jerry D. Johnson
*Attorney, Agent, or Firm*—Alan T. McDonald

[57] ABSTRACT

Metal working lubricants consisting essentially of water and complex organic phosphate esters are disclosed. These compositions offer simplified compositions while maintaining the desired properties of more complex systems.

19 Claims, No Drawings

AQUEOUS METAL WORKING LUBRICANT CONTAINING A COMPLEX PHOSPHATE ESTER

CROSS-REFERENCE TO RELATED APPLICATIONS

This is a continuation-in-part of U.S. application Ser. No. 23,887, filed Mar. 16, 1987, now abandoned, which is a continuation-in-part of U.S. application Ser. No. 14,323, filed Feb. 13, 1987, now abandoned.

FIELD OF THE INVENTION

The present invention relates to water soluble metal working lubricants and more specifically to lubricants useful in working aluminum.

BACKGROUND OF THE INVENTION

The prior art is replete with lubricant formulations useful in the rolling of metals such as aluminum.

With the evolution of rolling equipment toward rolling mills that produce higher pressures at ever-increasing operating speeds, the demands placed on the lubricants used in such mills have increased with each new generation of rolling equipment. Such increasing demands have resulted in further expansion of the list of lubricant formulations useful in rolling operations.

To the best of our knowledge, however, there are certain attributes which a metal working lubricant must possess to be a suitable material for cold working of metal, such as cold rolling of metal foil or sheet or foil-plastics film laminates, stamping, drawing and ironing. These attributes include the ability to (1) withstand the high shear forces encountered during metal working, (2) provide a highly specular surface, (3) exhibit extreme pressure lubricating properties, (4) operate as a single phase lubricant, (5) provide good heat transfer, (6) provide a clean, streak-free surface upon subsequent heat treatment, and (7) prevent transfer of metal oxides from the workpiece to the tool.

Each of these characteristics is familiar to the skilled lubricant technician. Most of the above-stated attributes are self-explanatory. Some of these, however, need further explanation.

The ability to provide adequate extreme pressure lubrication defines the ability of the lubricant to reduce or prevent conditions of seizure or welding between the tool, e.g., the rolling mill, etc., and the workpiece under conditions of extreme load.

The ability to operate as a single phase lubricant provides uniform fluid film in the tool-workpiece interface. It also permits the lubricant to undergo reclamation processes, such as filtration, centrifugation, etc.

The term single phase lubricant refers to a lubricant in which the components of the lubricant are soluble at room temperature. This is in contrast to macroemulsion lubricants, sometimes incorrectly referred to as "soluble oil" lubricants, and microemulsion lubricants, which have dispersed phase droplets predominately less than 0.2 micrometers in diameter.

Thus, it has been the aim of the formulators of lubricants to design a formulation which provides all of the foregoing properties.

However, most known lubricants which exhibit all of the desired properties have problems of their own. These problems include (1) fire hazard, (2) toxicity hazard, (3) unacceptable air emissions, (4) cost, and (5) poor productivity. These problems result from the fact that these lubricants are petroleum based.

It is also known from U.S. Pat. No. 4,636,321 to provide an aqueous lubricant which overcomes the problems associated with petroleum based lubricants. However, the compositions of this patent are relatively complex. When using these compositions, it is necessary to constantly monitor the working fluid to maintain the proper ratio of ingredients and replenish depleted components. Thus, it is a primary purpose of the present invention to provide an aqueous metal working lubricant of simplified composition, thereby permitting ease of maintenance of the working fluid while maintaining or improving all of the desirable lubricant properties of the known compositions.

SUMMARY OF THE INVENTION

There has now been discovered a water soluble lubricant which eliminates substantially all of the foregoing problems with such lubricants and demonstrates substantially improved lubricant characteristics by maintaining all of the functional properties of the more complex known lubricant compositions.

According to the present invention, there is provided a water soluble metal working lubricant consisting essentially of:

from about 0.1 to about 25 percent by weight of at least one complex organic phosphate ester having the formula

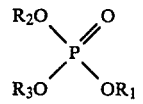

wherein $R_1$ is a polyoxyalkylated alcohol wherein the alcohol portion is derived from a member of the group consisting of saturated and unsaturated alkyl radicals having from about 1 to about 20 carbon atoms, aryl radicals, and alkylaryl radicals wherein the alkyl substituent comprises from about 1 to about 20 carbon atoms and is saturated or unsaturated, and wherein the polyoxyalkylated portion of $R_1$ is derived from ethylene oxide, propylene oxide, a polyhydroxy alkanol having from about 2 to about 10 carbon atoms, or a combination of these, wherein the number of monomeric units of any single type is from about 1 to about 100; and wherein $R_2$ and $R_3$ are defined as hydrogen or as is $R_1$ above, but need not be identical to $R_1$ or to each other, so long as they can be described as hydrogen or as is $R_1$; and from about 75 to about 99.9 percent by weight water.

Other minor components may be present in the lubricant. These include biocides, defoamers, and corrosion inhibitors. Biocides, defoamers, and corrosion inhibitors, when used, should not exceed, 0.001, 0.01, and 0.005 percent by weight, respectively, of the lubricant.

DETAILED DESCRIPTION OF THE PREFERRED EMBODIMENTS

The ingredients of metal working lubricants can be classified according to their primary functions. Traditional approaches to lubricant formulation select one or more components to fulfill each of these primary functions. When properly chosen, however, ingredients may be selected to perform multiple functions, thereby greatly simplifying the resulting lubricant formulation.

In the traditional approach, the aforementioned primary functional classes of lubricant ingredients may be described as: (1) the solvent and/or solubilizers, (2) the additive vehicle and (3) the lubricant additives. This final category is further subdivided into additives which provide or enhance (a) film strength and (b) boundary lubricating capabilities.

Water is present as the solvent in the lubricant composition of the present invention. The water provides good heat transfer by removing heat from the tool and the workpiece. The water also provides, in conjunction with the complex phosphate ester, a highly specular surface on the workpiece by assisting in the removal of wear debris. Because the components of the present invention are water soluble, additional solubilizing ingredients are not required. The concentration of water in the lubricant compositions of the present invention is from about 75 to about 99.9 percent by weight of the lubricant.

Prior art, such as U.S. Pat. No. 4,636,321 mentioned above, teaches the use of a vehicle fluid which separates from the in-use lubricant due to mechanical, thermal, or electrostatic effects, thereby depositing a film of the vehicle fluid and other lubricant additives at the tool-workpiece interface. In the.present invention, the need for a separate vehicle fluid has been avoided by the judicious selection of the complex phosphate ester lubricating additive, described below, which provides these properties.

The lubricating additive functions of protecting the metal surface from damage by the tool, thereby producing a highly specular surface, of preventing transfer of metal oxides from the workpiece to the tool, and of providing a clean, streak-free surface upon subsequent heat treatment of the workpiece, are fulfilled completely through the use of one or more complex organic phosphate esters. The functions of producing a highly specular surface and preventing transfer of metal oxides from the workpiece to the tool result from the extreme pressure properties, the film strength properties and the load support properties of the complex phosphate ester component. The function producing a clean, streak-free surface upon subsequent heat treatment of the workpiece results from the chemical structure of the phosphate ester molecule. These phosphate esters are in aqueous solution to form the working lubricant. Such additives concentrate at the tool-workpiece interface through such mechanisms as polar attraction and reduction of interfacial surface tension.

The extreme pressure properties of the lubricant composition are provided by the complex phosphate ester component. By virtue of chemical adsorption and surface tension reducing properties, the phosphate ester is attracted to the surfaces of both the tool and the workpiece. Under conditions of extreme temperature and pressure, the orthophosphate moiety reacts with the metal surfaces to form a high shear strength, low shear stress metallic phosphate complex.

The film strength and load support properties of the lubricant composition are also provided by the complex phosphate ester component. The unidirectional electrostatic attraction of the orthophosphate moiety to the metal surfaces provides a monomolecular layer of alkyloxylated hydrophobe above the metal surfaces as a film of high strength and good load carrying capability.

Useful complex organic phosphate esters are those having the formula

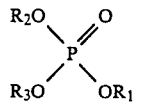

wherein $R_1$ is a polyoxyalkylated alcohol wherein the alcohol portion is derived from a member of the group consisting of saturated and unsaturated alkyl radicals having from about 1 to about 20 carbon atoms, aryl radicals, and alkylaryl radicals wherein the alkyl substituent comprises from about 1 to about 20 carbon atoms and is saturated or unsaturated, and wherein the polyoxyalkylated portion of $R_1$ is derived from ethylene oxide, propylene oxide, a polyhydroxy alkanol having from about 2 to about 10 carbon atoms, or a combination of these, wherein the number of monomeric units of any single type is from about 1 to about 100; and wherein $R_2$ and $R_3$ are defined as hydrogen or as is $R_1$ above, but need not be identical to $R_1$ or to each other, so long as they can be described as hydrogen or as is $R_1$.

The concentration of the complex organic phosphate ester or esters in the working lubricant solution of the present invention may be from about 0.1 to about 25 percent by weight of the lubricant. In a preferred embodiment of the present invention, the phosphate ester ingredient concentration in the lubricant may range between about 0.5 and about 2 percent by weight.

In a preferred embodiment of the present invention, $R_1$ is a polyoxyethylated four to twelve carbon normal alcohol, $R_2$ and $R_3$ are each hydrogen, and the weight percent of polyoxyethylation is from about 40 to about 80 percent of the molecular weight of the complex organic phosphate ester molecule.

In certain cases, the pH of the lubricant solution may be adjusted through the use of inorganic bases or mineral acids. The pH of the lubricant compositions of the present invention may range from about 1.5 to about 9. Useful such inorganic bases include NaOH, $NaHCO_3$, KOH, $Ca(OH)_2$, and $Mg(OH)_2$. Useful such mineral acids include $H_2SO_4$ and $H_3PO_4$. Those skilled in the art will readily recognize those inorganic bases and mineral acids useful for the adjustment of solution pH in metal-working lubricant applications. In a preferred embodiment of the present invention, no such pH adjustment of the lubricant solution is necessary.

Complex organic phosphate esters of the type described hereinabove are readily available under the following tradenames from these companies: "Maphos" from Mazer Chemicals, Inc. of Gurnee, Ill., "Cyclophos" from Cyclo Chemicals Corporation of Miami, Fla., "Gafac" and "Antara" from GAF Corporation of New York, N.Y., "Vanlube" from R. T. Vanderbilt Company, Inc. of Norwalk, Conn., and "Atphos" from ICI Americas, Inc. of Wilmington, Del.

The complex organic phosphate esters must be soluble in water at room temperature in order to provide adequate removal and dispersion of wear debris from the metal working operation. These characteristics, as well as the characteristics of polarity, reduction of surface tension, sometimes referred to as wetting, protection of the metal surface, prevention of oxide transfer, production of a specular surface, and acceptable heat treatability, are governed by the judicious selection of the $R_1$, $R_2$, and $R_3$ substituents, as defined hereinabove.

Other minor components well-known to those skilled in lubricant formulation may be present in the lubricant compositions of the present invention. These include biocides, such as "Kathon 886 MW" from Rohm and Haas, Inc. of Philadelphia, Pa., defoamers such as "Foamkill 649-G" from Crucible Chemical Corporation of Greenville, S.C., and corrosion inhibitors such as "Katapone VV328" from GAF Corporation of New York, N.Y. Biocides, defoamers, and corrosion inhibitors, when used, should not exceed about 0.001, 0.01, and 0.005 percent by weight, respectively, of the lubricant composition.

EXAMPLE

A lubricant composition according to the present invention was prepared from 99.0 percent by weight water and 1.0 percent by weight of a complex organic phosphate ester having the formula

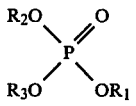

wherein $R_1$ was a polyoxyethylated $C_6$ normal alcohol, wherein $R_2$ and $R_3$ were each hydrogen and wherein the weight percent of polyoxethylation was 55 percent of the molecular weight of the molecule, with no pH adjustment.

This lubricant was employed to roll aluminum alloy sheet on a four-high sixty inch wide foil mill from 0.012 inch to 0.001 inch in a single pass. The foil produced was of acceptable commercial quality and was run under normal commercial practices.

While the lubricant compositions of the present invention have been described with reference to certain specific embodiments thereof, it is not intended to be so limited thereby, except as set forth in the accompanying claims.

We claim:

1. A metal working lubricant composition consisting essentially of:

from about 0.1 to about 25 percent by weight of at least one complex organic phosphate ester having the formula

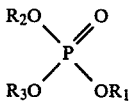

wherein $R_1$ is a polyoxyalkylated alcohol wherein the alcohol portion is derived from a member of the group consisting of saturated and unsaturated alkyl radicals having from about 1 to about 20 carbon atoms, aryl radicals, and alkylaryl radicals wherein the alkyl substituent comprises from about 1 to about 20 carbon atoms and is saturated or unsaturated, and wherein the polyoxyalkylated portion of $R_1$ is derived from ethylene oxide, propylene oxide, a polyhydroxy alkanol having from about 2 to about 10 carbon atoms, or a combination of these, wherein the number of monomeric units of any single type is from about 1 to about 100; and wherein $R_2$ and $R_3$ are defined as hydrogen or as is $R_1$ above, but need not be identical to $R_1$ or to each other, so long as they can be described as hydrogen or as is $R_1$; and from about 75 to about 99.9 percent by weight water.

2. The lubricant composition of claim 1 wherein said complex phosphate ester component is present in an amount of from about 0.5 to about 2 percent by weight.

3. The lubricant composition of claim 1 wherein $R_1$ is a polyoxyethylated four to twelve carbon normal alcohol, $R_2$ and $R_3$ are each hydrogen, and the weight percent of polyoxyethylation is from about 40 to about 80 percent of the molecular weight of the said complex phosphate ester molecule.

4. The lubricant composition of claim 1 wherein said complex phosphate ester component is present in an amount of 1 percent by weight, and wherein $R_1$ is a polyoxyethylated $C_6$ normal alcohol, $R_2$ and $R_3$ are each hydrogen, and the weight percent of polyoxyethylation is 55 percent of the molecular weight of said complex phosphate ester.

5. The lubricant composition of claim 1 further consisting essentially of an amount up to about 0.001 percent by weight of a biocide.

6. The lubricant composition of claim 1 further consisting essentially of an amount up to about 0.01 percent by weight of a defoamer.

7. The lubricant composition of claim 1 further consisting essentially of an amount up to about 0.005 percent by weight of a corrosion inhibitor.

8. The lubricant composition of claim 1 wherein said composition has a pH of from about 1.5 to about 9.

9. The lubricant composition of claim 1 wherein said composition has its pH controlled through the use of an inorganic base.

10. The lubricant composition of claim 9 wherein said inorganic base is selected from a member of the group consisting of NaOH, $NaHCO_3$, KOH, $Ca(OH)_2$ and $Mg(OH)_2$.

11. The lubricant composition of claim 1 wherein said composition has its pH controlled through the use of a mineral acid.

12. The lubricant composition of claim 11 wherein said mineral acid is selected from a member of the group consisting of $H_2SO_4$ and $H_3PO_4$.

13. The lubricant composition of claim 1 further consisting essentially of an amount up to about 0.001 percent by weight of a biocide.

14. The lubricant composition of claim 1 further consisting essentially of an amount up to about 0.01 percent by weight of a defoamer.

15. The lubricant composition of claim 13 further consisting essentially of an amount up to about 0.01 percent by weight of a defoamer.

16. The lubricant composition of claim 1 further consisting essentially of an amount up to about 0.005 percent by weight of a corrosion inhibitor.

17. The lubricant composition of claim 13 further consisting essentially of an amount up to about 0.005 percent by weight of a corrosion inhibitor.

18. The lubricant composition of claim 14 further consisting essentially of an amount up to about 0.005 percent by weight of a corrosion inhibitor.

19. The lubricant composition of claim 15 further consisting essentially of an amount up to about 0.005 percent by weight of a corrosion inhibitor.

* * * * *